United States Patent [19]

Solheim

[11] Patent Number: 4,951,754

[45] Date of Patent: Aug. 28, 1990

[54] FIRE EXTINGUISHING PLANT FOR THREE EXTINGUISHING AGENTS

[76] Inventor: Odd Solheim, Brekke, N-4250 Kopervik, Norway

[21] Appl. No.: 393,583

[22] Filed: Aug. 14, 1989

[51] Int. Cl.[5] ..... A62C 35/44; A62C 35/34; A62C 35/16

[52] U.S. Cl. ..... 169/15; 169/9; 169/14

[58] Field of Search ..... 169/14, 15, 44, 9, 11

[56] References Cited

U.S. PATENT DOCUMENTS

| | | | |
|---|---|---|---|
| 1,148,763 | 8/1915 | Fagan | 169/44 |
| 1,467,377 | 9/1923 | Hamilton | 169/14 |
| 1,592,346 | 7/1926 | Erwin | 169/14 |
| 1,829,714 | 10/1931 | McElroy et al. | 169/15 |
| 3,848,675 | 11/1974 | Evans | 169/15 |
| 4,390,069 | 6/1983 | Rose, Jr. | 169/15 |
| 4,729,434 | 3/1988 | Rohrbach | 169/15 X |

FOREIGN PATENT DOCUMENTS

| | | | |
|---|---|---|---|
| 314354 | 5/1989 | European Pat. Off. | 169/14 |
| 2575082 | 6/1986 | France | 169/15 |
| 526820 | 5/1955 | Italy | 169/15 |
| 150528 | 8/1984 | Japan | 169/14 |
| 1215724 | 3/1986 | U.S.S.R. | 169/14 |

*Primary Examiner*—Joseph F. Peters, Jr.
*Assistant Examiner*—James M. Kannofsky
*Attorney, Agent, or Firm*—Ladas & Parry

[57] ABSTRACT

Fire extinguishing plant for three extinguishing agents, water, powder-mixed water and heavy foam, comprising water supply conduits (4, 5, 6) from a source of pressurized water to a number of spraying nozzles (2, 3), and wherein there to the water supply conduits (4, 5, 6) being provided an inlet (7) for admixing foam agent. Moreover, to each nozzle (2, 3) therein being provided supply conduits (9, 10, 11) for a non-combustible gas, siad conduits having a device (13) for admixing fire extinguishing powder into the gas. The supply conduits for the non-combustible gas have a non-return valve (28) adjacent the outlet; there being provided a bypass conduit (14) in the gas supply conduit past the device (13) for the admixing of powder.

An arrangement in spraying nozzles for use in the plant comprises a preferably circular housing (15), on end of which is closed, the other end thereof being open and having a radially extending annular flange (32). At the open end, there being provided a disc-shaped valve plate (18) having radial grooves (30) in the inner surface, corresponding to likewise radial grooves (31) in the outer surface of the flange (32). The valve plate (18) has a valve stem (19) which is fastened adjustably in the axial direction in the rear end of the housing (15). The valve stem (19) has a blind bore (26) from its inner end, adapted for connection of the supply conduit for gas-carried powder. In the wall of the blind bore there being provided a number of radial holes (27) equipped with non-return valve (28).

6 Claims, 2 Drawing Sheets

Fig.1
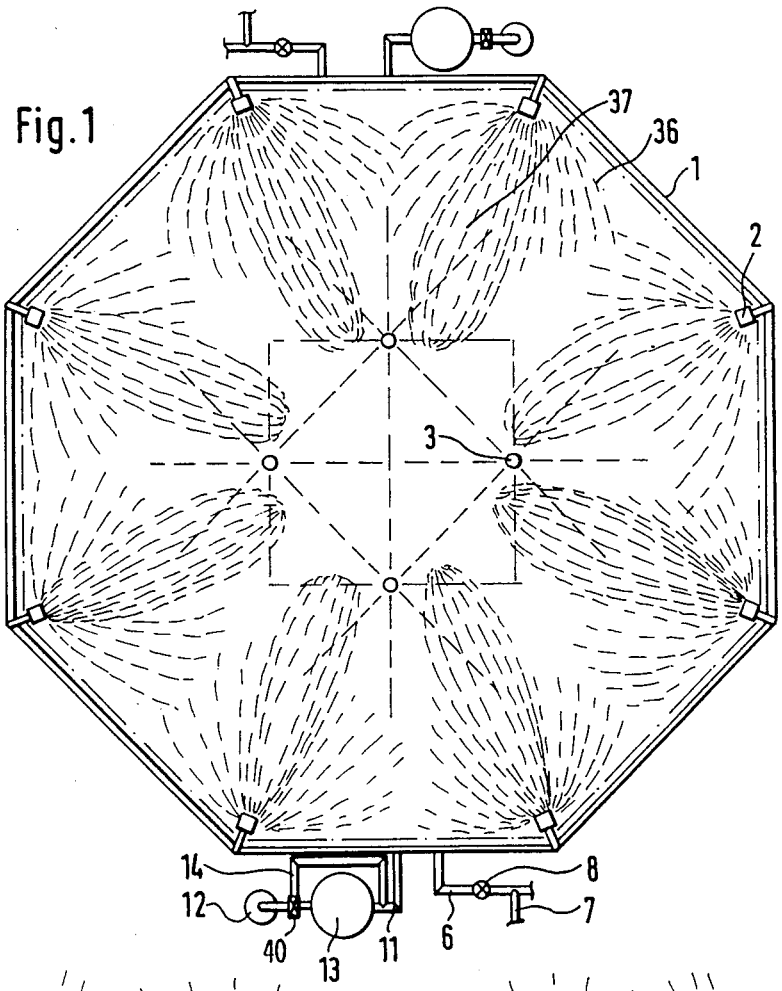
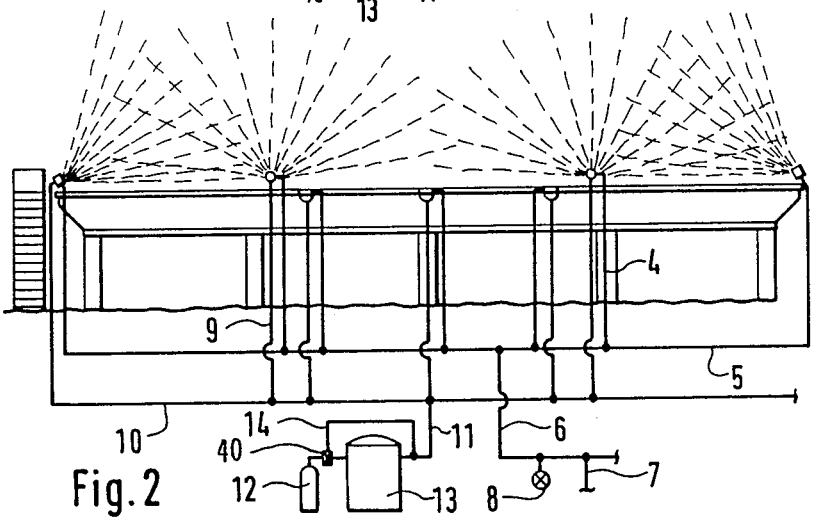
Fig.2

Fig. 3
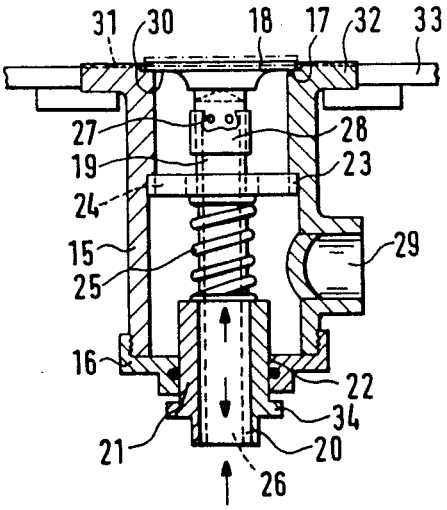
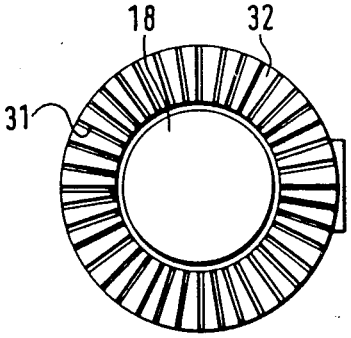
Fig. 4
Fig. 5
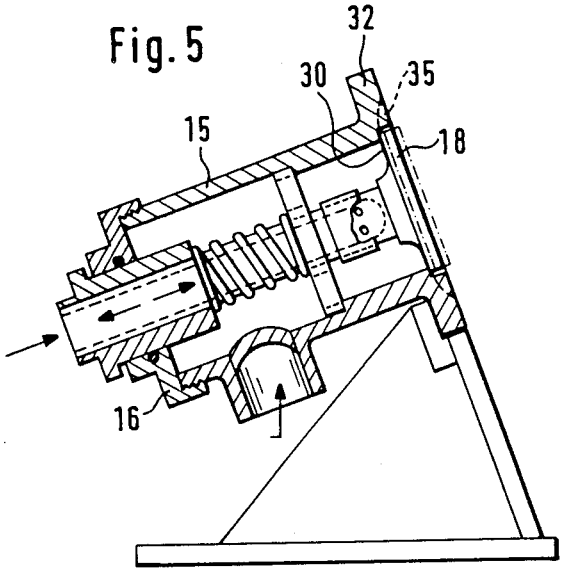
Fig. 6
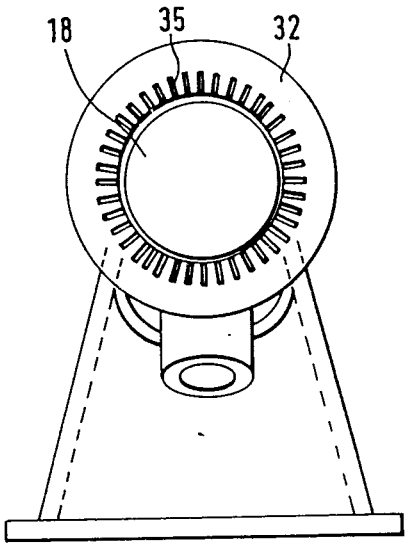

FIRE EXTINGUISHING PLANT FOR THREE EXTINGUISHING AGENTS

The present invention relates to a fire extinguishing plant for three extinguishing agents, namely water, powder-mixed water and heavy foam, comprising a water supply conduit from a source of pressurized water to a number of spraying nozzles, and wherein to the water supply conduit a supply inlet for the admixture of foaming agent is arranged. Further, the invention comprises an arrangement in spraying nozzle for use in the plant.

In connection with the fire extinguishing plants hitherto available, one has only been able to use two fire extinguishing agents, viz. water and heavy foam. These two fire extinguishing agents may be supplied to the nozzles via the same supply conduits. If one shall use the third fire extinguishing agent, powder-mixed water, one must arrange a further supply conduit for this agent, and if one then uses heavy foam, this will easily penetrate into the further supply conduit and clog it. The same will be the case when one uses powder-mixed water, namely that this may penetrate into the supply conduit for powder-mixed water. Thus, there has not existed means, neither entire plants nor nozzles, of such a kind that the three said fire extinguishing agents could be used optionally. Another problem with such plants is that the gas-carried powder will deposit on the walls of the conduit and within the nozzle after the plant has been in use with powder-mixed water as extinguishing agent.

The present invention aims at providing directions for a fire extinguishing plant wherein all the three said extinguishing agents may be used optionally, and wherein said disadvantages are avoided. This is achieved through a plant of the introductorily mentioned kind which is characterized in that there being arranged a supply conduit for a non-compustible gas to each nozzle, and a device for admixing fire extinguishing powder into the gas; that the supply conduit for the non-combustible gas, adjacent the outlet, has a non-return valve, and that there being arranged a bypass conduit in the gas supply conduit past the device for the admixing of powder.

The non-return valve which is arranged within the supply conduit for the non-combustible gas, is preferably arranged within the nozzle itself, and this will prevent foam and water from penetrating into the supply conduit for the gas when the plant is used for water or heavy foam. The arrangement of a bypass conduit within the gas supply conduit past the device for admixing powder, gives a possibility for efficient cleaning of the gas conduit and the nozzle, in that conduit and nozzle may be blown clean of powder residues after the plant has been in use.

The invention further relates to an arrangement in a spraying nozzle for use in the plant according to the invention. The spraying nozzle in accordance to the invention is a further development of a known nozzle comprising a preferably circular casing one end thereof being closed, the other end being open and having a radially directed annular flange, at the open end there being arranged a disc-shaped valve plate having radial grooves in the inner surface corresponding to likewise radial grooves in the outer surface of the annular flange, said valve plate having a valve stem fastened adjustably in the axial direction in the rear end of the casing. The distinctive feature of the invention is that the valve stem has a blind bore from its inner end with a connection for the supply conduit for gas-carried powder, and that in the wall of the blind bore there being arranged a number of radial holes equipped with non-return valves. A practical embodiment is characterized in that the non-return valve consists of a rubber sleeve or ring for the valve stem, covering the holes.

A further development of the invention is characterized in that the valve plate is spring-loaded toward its seat in the radially directed annular flange. Preferably according to the invention, the spring is a screw spring arranged around the valve stem, and which with its external end rests against a traverse extending laterally within the casing and with its other end against a sleeve attached through a screw joint to the rear end of the valve stem and which is slidably arranged in a guidance in the rear wall of the casing, said sleeve having a stop intended to cooperate with the rear end of the casing.

The blind bore and the radially directed openings will carry the powder well distributed into the front end of the nozzle, where it is admixed with water supplied to the nozzle from the water conduit. The non-return valve prevents heavy foam from penetrating into the gas supply conduit when the nozzle is used for heavy foam.

In the following, the invention shall be explained further with reference to the drawing, wherein FIG. 1 shows the plant used in connection with a helicopter deck, as seen straight from above;

FIG. 2 shows schematically the plant in FIG. 1 in side elevation, and shows especially the connection of conduits to the nozzles;

FIG. 3 shows a vertical section through a first embodiment of a nozzle, intended for mounting in a horizontal or approximately horizontal surface;

FIG. 4 shows the nozzle seen straight from above;

FIG. 5 shows a vertical section through a second embodiment of a nozzle according to the invention, intended to be mounted in a vertical or somewhat inclining surface; and FIG. 6 shows the nozzle according to FIG. 5 seen from the front.

FIG. 1 shows an octagonal helideck 1, in each corner of which there being mounted a nozzle 2 of the kind to be described further with reference to FIGS. 5 and 6. In the deck itself, there being mounted a number of nozzles 3 of a kind to be further described with reference to FIGS. 3 and 4. To the nozzles, three different extinguishing agents may be supplied, namely water, powder-mixed water and heavy foam. Thus, the nozzles are each associated with its separate supply conduit 4 for water and foam. For the water supply conduits 4 there is provided a main conduit 5 having a supply conduit 6 from a water source (not shown). On the supply conduit there is connected a conduit 7 for the supply of a foaming agent, and a blowout valve 8, the function of which will be explained below.

Moreover, each nozzle is supplied with a conduit 9 for the supply of powder-mixed inert gas, e.g. nitrogen. In this case there being also provided a main conduit 10 supplied from a conduit 11. The gas source is a battery of gas cylinders 12. Powder is supplied to the gas from a container 13, e.g. by means of ejector effect. Via a valve 40, a bypass conduit 14 may carry the gas on the outside of the powder-supply container 13.

When the plant is to be used in connection with water as extinguishing agent, the water supply conduit 6 to the nozzles 2 and 3 is opened, while the supply of foaming agent is closed. When the plant is to be used for heavy foam, both the supply conduit 6 and the supply conduit 7 for foaming agent are open. If the plant is to be used for powder-mixed water, water is supplied through the conduits 4, 5, 6, gasmixed powder being simultaneously supplied through the conduits 9, 10, 11. Then, the supply conduit for foaming agent is closed.

When the plant is to be cleaned after use, the outlet valve 8 is opened and gas is supplied to the conduits 9, 10, 11 via the shunt conduit 14, so that powder from the tank 13 is not admixed. Then, the entire plant will be cleaned for powder residues both in nozzle and conduits 9, 10, 11, and the gas will force water and foam back into the conduits 4, 5, 6 and out through the outlet valve 8. Thereafter, one will have an entirely clean plant, without risks of clogging in valves, conduits or nozzles. This is of the greatest importance for the state of readiness.

Nozzle type according to FIG. 3, which is intended for mounting in a horizontal or approximately horizontal surface, is intended to spray extinguishing agent in all directions horizontally, and will lay extinguishing agent out over a surface and thereby prevent fire from arising in the deck or in combustible matter that might be situated on the deck, e.g. oil or leaked fuel. The nozzle consists of a housing 15 closed at one end by means of a cover 16. The other end of the housing is open and at the edges thereof provided with an annular valve seat 17 for a valve plate 18, which is attached to the end of a valve stem 19. By means of external threads 20, the valve stem 19 is adjustably fastened in a sleeve 21 which is slidably arranged in a circular opening 22 in the cover 16. In the valve housing, there is arranged a traverse in the form of a disc 23 having a number of through-going holes 24. Between the traverse 23 and the sleeve 21, a screw spring 25 is provided. From the rear end of the valve stem, there being provided a blind bore 26 terminating adjacent the valve plate 18. Adjacent the blind end of the bore, there being provided a number of radially directed holes 27 which are covered by a resilient rubber sleeve or ring 28. The free end of the valve stem 19 extends beyond the rear end of the sleeve 21 and is intended for connection of the supply conduit 9 for powder-mixed gas. Besides, at the housing there is an inlet 29 for connecting the water conduit 4.

In the valve plate 18, there is provided a number of radially directed grooves 30 in the lower surface, i.e. the surface directed toward the housing 15. These grooves correspond to radially directed grooves 31 arranged in a radially extending annular flange 32 on the open end of the housing 15. The annular flange 32 is attached in a deck 33 or the like.

The nozzle operates in the following manner. When an extinguishing agent is supplied to the nozzle, e.g. water through the conduit 4 and the inlet 29, the water pressure in the housing will lift the valve plate 18 from the seat 17 against the action of the spring 25, such that water will flow out through the slits 30 and 31, and in pulverized form be hurled outward in all directions. The movement of the valve plate 18, i.e. lifting from the seat 17, is controlled by means of an outward extending annular flange 34 at the free end of the sleeve 21. The spring pressure on the valve plate will be controlled in the same manner. The purpose of the control is to obtain full effect of the water pressure available. The higher water pressure available, the larger opening can be allowed in the outlet of the nozzle. If smaller water pressure exists, the outlet opening must be reduced in order to achieve full drop formation when the extinguishing agent leaves the valve.

The rubber sleeve 28 will be pressed outward in radial direction when powder is used as extinguishing agent, and gas-carried powder will be evenly distributed in the foremost end of the housing and will be efficiently admixed with water entering through the opening 29, and carried out through the slots 30, 31. On the other hand, when water or heavy foam is used, the conduit for the supply of gas will be closed, and the water or the foam will build up a pressure in the housing and, thus, press the rubber sleeve 28 against the stem 19, so that the openings 27 become closed.

The nozzle according to FIG. 5 is identical to the nozzle according to FIG. 3, apart from the fact that the grooves or slits 35 in the annular flange 32 have an inclined course. This shape of the slits will cause a hurling-out of extinguishing agents as shown in FIG. 1, viz. a spherical portion 36 and a more far-reaching portion 37.

The plant and the nozzles according to the invention are described in connection with a helideck 1. However, a number of other applications are conceivable, e.g. on ships, processing plants and industrial plants of different kinds, wherein the risk of fire, e.g. in chemicals or hydrocarbons, is particularly great.

I claim:

1. Fire extinguishing plant for three extinguishing agents, water, powder-mixed water and heavy foam, comprising water supply conduits (4, 5, 6) supplying water from a water source to a number of spraying nozzles (2, 3), and wherein into the water supply conduit there being provided an inlet (7) for the supply of foam agent, c h a r a c t e r i z e d i n that there being provided supply conduits (9, 10, 11) for a noncombustible gas, e.g. nitrogen gas, for supplying said gas to each nozzle (2, 3), and a device (13) for admixing fire extinguishing powder into the gas; that the supply conduits (9, 10, 11) for the non-combustible gas, adjacent the nozzles, have a non-return valve (28), and that there being provided a bypass conduit (14) in the gas supply conduit, past the device (13) for admixing powder.

2. Arrangement in each spraying nozzle supplied by the plant according to claim 1, comprising a preferably circular housing (15), one end thereof being closed and the other end thereof being open and having a radially extending annular flange (32), and wherein there, at the open end of the housing, being provided a disc-shaped valve plate (18) having radial grooves (30) in its inner surface, said grooves corresponding with likewise radial grooves (31, 35) in the outer surface of the flange (32), said valve plate (18) having a valve stem (19) secured adjustably in the axial direction in the closed end of the housing (15), c h a r a c t e r i z e d i n that the valve stem (19) has a blind bore (26) from its end in the closed end of the housing (15), adapted for connection of the supply conduit for gas-carried powder, and that, in the wall of the blind bore, there being provided a number of radial holes (27) equipped with a non-return valve (28).

3. Device according to claim 2, c h a r a c t e r i z e d i n that the valve plate (18) has a seat (17) in the radial annular flange (32) and is spring-loaded in the direction of its seat (17) in.

4. Device according to claim 3, c h a r a c t e r i z e d i n that the spring is a screw spring (25), arranged around the valve stem (19) and resting with one end thereof against a traverse (23) extending laterally of the housing (15) and with the other end thereof against a sleeve (21) attached through threads to the end of the valve stem (19) in the closed end of the housing (15) and being slidably arranged in a guidance (22) in the closed end of the housing (15), said sleeve having a stop (34) adapted to cooperate with the closed end of the housing (15).

5. Device according to claim 2, c h a r a c t e r i z e d i n that the non-return valve consists of a rubber sleeve (28) covering the holes (27) and being arranged on the valve stem (19).

6. Device according to claim 2, characterized in that the non-return valve consists of a rubber ring (28) covering the holes (27) and being arranged on the valve stem (19).

* * * * *